United States Patent [19]

Block et al.

[11] 4,118,962

[45] Oct. 10, 1978

[54] OBTURATOR FOR SAFE DEPOSIT BOXES AND THE LIKE

[75] Inventors: Mitchell L. Block, Highland Park; Angelo Pane, Chicago, both of Ill.

[73] Assignee: Block and Company, Inc., Wheeling, Ill.

[21] Appl. No.: 825,261

[22] Filed: Aug. 17, 1977

[51] Int. Cl.[2] ..... E05B 17/14

[52] U.S. Cl. ..... 70/455; 70/423

[58] Field of Search ..... 70/57, 455, 423, 424; 85/5 R, DIG. 2; 24/73 SM, 73 P, 73 SC, 107, 213 B, 214

[56] References Cited

U.S. PATENT DOCUMENTS

| | | | |
|---|---|---|---|
| 3,029,486 | 4/1962 | Raymond | 85/DIG. 2 |
| 3,335,633 | 8/1967 | Seckerson | 85/5 R |
| 3,342,095 | 9/1967 | Buntic | 24/73 P |
| 3,475,934 | 11/1969 | Reisner | 70/455 |
| 3,869,958 | 3/1975 | Murayama | 24/73 P |

*Primary Examiner*—Robert L. Wolfe
*Attorney, Agent, or Firm*—Norman Lettvin

[57] ABSTRACT

An improved obturator for safe deposit boxes and the like is integrally manufactured from a resilient synthetic material such as nylon. It includes a substantially flat head member having a rail member cantilevered perpendicularly from one side thereof. In the preferred embodiment, the rail member includes three elongated arms each joined at both ends thereof to transverse end and distal end members. One arm, centrally positioned, is straight and serves to limit the maximum spacing between the said transverse end members, while the upper and lower arms are provided longer than the one arm and bend outwardly, flexibly and resiliently, on opposite sides of the longitudinal plane of the central arm. This permits the longer arms, when flexed, to contact opposite interior portions of the key hole channel to frictionally resist withdrawal, and to also engage lock tumblers in the keyhole channel, thereby preventing accidental obturator withdrawal.

4 Claims, 2 Drawing Figures

FIG. 1
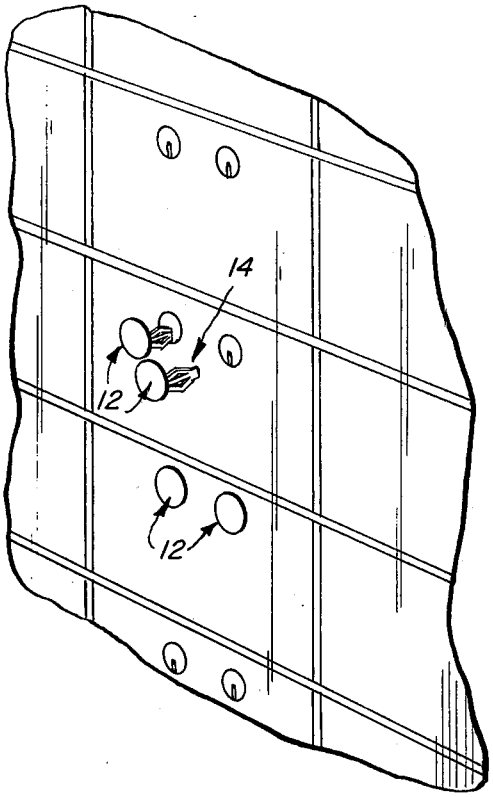
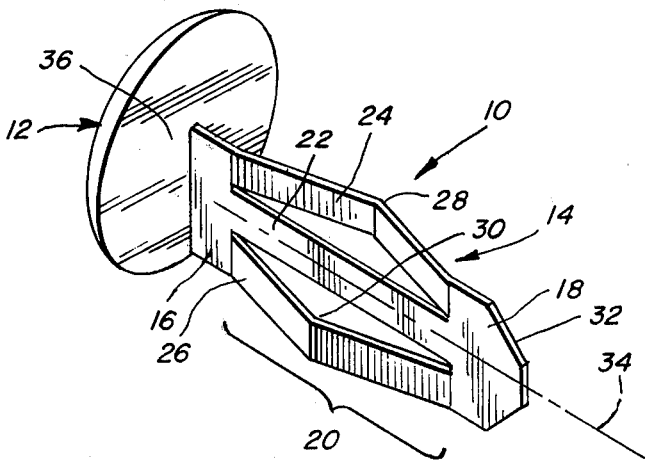
FIG. 2

OBTURATOR FOR SAFE DEPOSIT BOXES AND THE LIKE

FIELD OF THE INVENTION

This invention relates to an obturator for safe deposit boxes and more particularly to an inexpensive and improved integrally formed obturator constructed to prevent unintentional removal.

BACKGROUND OF THE INVENTION

Obturators for safe deposit boxes and other keyholed devices such as doors and lockers are well known. In the case of safe deposit boxes, they are employed to block the keyhole entrance when access to the contents of the boxes is prohibited by court or government order. Many times the obturators are color coded so as to distinguish between governmental, court, and banking reasons for refusing access.

Those obturators in current use include a planar, peripherally flanged head member and a relatively thin, elongated rail member. A planar extension on the rail member, shaped and sized to be received in and gripped by the head member's flange, is formed perpendicular to and integral with the head end of the rail member. The rail member is deformed at various points along its length and folded at its midpoint. The deformed areas of the rail member, and the adjacent walls thereof, extend laterally outward to effect purchase with opposite interior walls of a keyhole channel.

However, prior obturators have been relatively expensive to produce due to their metallic manufacture, are time consuming to assemble due to their two piece construction, require an additional step of painting for color coding, and fail to always provide a tight keyhole fit, resulting in inadvertent slippage.

It is one object of this invention to provide an integrally formed obturator that is manufactured from colored synthetic resilient materials for reducing manufacturing cost.

Another object of this invention is to provide a one-piece obturator with portions thereof formed to provide resilient lateral pressure against the sides of a keyhole channel to inhibit accidental withdrawal.

Other objects and advantages of the invention will become clear from the following description of the preferred embodiment of the invention.

BRIEF SUMMARY OF THE INVENTION

The head and rail member of the obturator of the present invention are integrally constructed of a synthetic material such as nylon to reduce manufacturing costs. The elongated rail member is perpendicularly cantilevered from one side of the flat head member. Joined only at the head end and the distal end of the rail member are three spaced, elongated arms. The central of the three arms extends perpendicularly to the head member, while the upper and lower arms are longer than the central arm and resiliently bend between the transverse members at the head and diatal ends of the rail, to extend transversely in opposite directions laterally of the longitudinal plane of the central arm. The bent obturator arms are thereby able to contact opposite interior sides of the keyhole, and to develop a resilient lateral force, preventing easy or inadvertent withdrawal of the obturator. To facilitate entry of the obturator into a keyhole and to conform with the off-center slotting of keyhole channels, the longitudinal centerline of the rail member is offset from the center of the head member.

DESCRIPTION OF THE DRAWINGS

FIG. 1 is a fragmentary view of a segment bank vault showing a typical column of safe deposit boxes. The top box shows the normal radially offset key raceways. The second box shows a pair of obturators of this invention about to be inserted in the key raceways. The bottom box shows the obturators seated in the key raceways with the obturator heads lying flush against the raceway faces; and FIG. 2 is an enlarged perspective view of the obturator of this invention showing an exaggerated outward bend of the upper and lower arms.

DESCRIPTION OF THE PREFERRED EMBODIMENT

Referring now to the drawings, the obturator of this invention is shown generally at 10 and is sized to fit within the keyholes of safe deposit boxes, doors, lockers and the like. The obturator comprises a substantially flat head member 12 and an elongated rail member 14.

The head member and rail member are integrally manufactured of a resilient synthetic material. Although plastics such as polyethylene and polypropylene are suitable substitutes, nylon, because of its wear characteristics, is preferred.

Further, any of the above noted materials may be molded in a wide variety of colors. Since color is a desirable feature in the practical use of obturators, a good deal of time and expense is saved when the coloring and molding comprise a single manufacturing stage.

The head member 12 is preferably circular in shape, although other configurations can be used without departing from the spirit of the invention. The rail member 14 is cantilevered from one side of the head member 12 and in a direction generally perpendicular thereto.

The rail member 14 includes one head end member 16 attached to the head member 12 and an unattached distal end member 18. In the preferred embodiment, the intermediate portion 20 of rail member 14 is defined by three elongated arms 22, 24 and 26 that are transversely spaced from each other. The ends of said arms merge with transverse head end member 16 and distal end member 18.

The intermediate portion of the first centrally positioned arm 22 is straight and extends perpendicularly from the head end member 16. The upper and lower arms, 24 and 26 respectively, are longer than the central arm 22. Because of their length, the upper and lower arms are resiliently bent along their intermediate portions, as at 28 and 30, to extend laterally beyond opposite sides of the longitudinal plane of the first arm. The straight central arm further serves to limit the maximum lateral spacing of the upper and lower arms. The obturator rail means thereby exert substantial, resilient, lateral pressure on the spaced, lateral walls of a keyhole into which they may be inserted.

There are two mechanisms provided by the present invention which aid in the insertion of the obturator into the keyhole of the safe deposit box or other like device. First, the distal end 18 of the rail member 14 is tapered as at 32. And second, the centerline 34 of the rail member 14 is offset from the center 36 of the head member 12. The combination taper and offset allow the obturator to be inserted in a keyhole in much the same manner as a key. The offset further conforms with the off-center slotting of keyhole raceways to permit the head member to be centrally positioned to cover the face of the keyhole opening.

OPERATION

The head member 12 of the obturator is grasped between the user's thumb and fingers and aligned with the keyhole. Because of the tapered distal end 32 and the offset centerline 34 of the rail member, minimum manipulation is needed to insert the distal obturator end into the keyhole raceway. By applying pressure against the exterior surface of the head member 12, the obturator slides into the raceway until the interior surface of the head member lies flush with the face of the keyhole. The deformations 28 and 30 of the intermediate portions of the second and third rail arms 24 and 26 are biased inwardly by the opposite interior sides of the keyhole channel thereby preventing accidental withdrawal.

While one form of the invention has been described, it will be understood that the invention may be utilized in other forms and environments, so that the purpose of the appended claims is to cover all such forms of devices not disclosed but which embody the invention disclosed herein.

What I claim is:

1. An obturator for safe deposit boxes and the like including substantially flat head means and elongated rail means cantilevered generally perpendicularly from one side of said head means, the improvement comprising in combination:

the rail means and the head means being integrally formed of a flexible material;

the rail means including a head end member and a distal end member;

the rail means comprising a plurality of elongated arms joined at said head end member and said distal end member;

the portion of at least one of said arms intermediate the ends being resiliently bent such that the arms lie in a common plane only at said head end member and said distal end member, whereby as the obturator is inserted into a keyhole of a safe deposit box or the like, the resiliently bent arms exert pressure against the sides of the keyhole channel and frictionally resist accidental withdrawal;

and said rail means consisting of three arms:

(a) a straight, centrally positioned arm;

(b) an upper arm resiliently bent to extend laterally beyond one side of the longitudinal plane of said first arm; and (c) a lower arm resiliently bent to extend laterally beyond the second side of the longitudinal plane of the first arm, the upper and lower arms being longer than the central arm, whereby the bent, intermediate portions of the longer arms exert oppositely directed lateral pressure within the keyhole.

2. The obturator of claim 1 wherein the distal rail means end member is tapered to aid keyhole insertion.

3. The obturator of claim 1 wherein the flexible material is nylon.

4. The obturator of claim 1 wherein the longitudinal centerline of the rail means is offset from the center of the head means.

* * * * *